US008362629B2

(12) United States Patent
Weber et al.

(10) Patent No.: US 8,362,629 B2
(45) Date of Patent: Jan. 29, 2013

(54) ENERGY MANAGEMENT SYSTEM FOR HEAVY EQUIPMENT

(75) Inventors: Robert Weber, Wadsworth, IL (US); Joseph Helfrich, Milwaukee, WI (US); John Luvaas, Mequon, WI (US)

(73) Assignee: Bucyrus International Inc., South Milwaukee, WI (US)

( * ) Notice: Subject to any disclaimer, the term of this patent is extended or adjusted under 35 U.S.C. 154(b) by 373 days.

(21) Appl. No.: 12/730,027

(22) Filed: Mar. 23, 2010

(65) Prior Publication Data

US 2011/0233931 A1 Sep. 29, 2011

(51) Int. Cl.

| | |
|---|---|
| ***F02D 25/00*** | (2006.01) |
| *G05D 1/02* | (2006.01) |
| *G05D 1/04* | (2006.01) |
| *F16D 31/02* | (2006.01) |
| *B66F 9/02* | (2006.01) |

(52) U.S. Cl. ..... 290/4 D; 37/348; 60/414; 187/224

(58) Field of Classification Search ..... 290/4 D; 37/348; 60/414; 187/224

See application file for complete search history.

(56) References Cited

U.S. PATENT DOCUMENTS

| | | | | |
|---|---|---|---|---|
| 3,512,072 | A * | 5/1970 | Karazija et al. | 320/127 |
| 4,723,107 | A * | 2/1988 | Schmid | 322/35 |
| 4,761,954 | A * | 8/1988 | Rosman | 60/414 |
| 5,491,913 | A | 2/1996 | Hutchinson | 37/311 |
| 5,953,838 | A * | 9/1999 | Steenwyk | 37/348 |
| 6,005,360 | A | 12/1999 | Pace | 318/376 |
| 6,164,388 | A | 12/2000 | Martunovich et al. | 175/1 |
| 6,230,496 | B1 * | 5/2001 | Hofmann et al. | 60/706 |
| 6,323,608 | B1 | 11/2001 | Ozawa | 318/139 |
| 6,326,763 | B1 | 12/2001 | King et al. | 320/101 |
| 6,422,001 | B1 | 7/2002 | Sherman et al. | 60/274 |
| 6,460,332 | B1 * | 10/2002 | Maruta et al. | 60/414 |
| 6,584,769 | B1 | 7/2003 | Bruun | 60/414 |
| 6,591,758 | B2 | 7/2003 | Kumar | 105/35 |
| 6,612,246 | B2 | 9/2003 | Kumar | 105/34.2 |

(Continued)

FOREIGN PATENT DOCUMENTS

EP 1191155 1/2010

OTHER PUBLICATIONS

International Search Report and Written Opinion for International Application No. PCT/US2010/050642, mail date May 30, 2011, 7 pages.

*Primary Examiner* — Pedro J Cuevas
(74) *Attorney, Agent, or Firm* — Foley & Lardner LLP

(57) ABSTRACT

Equipment having an energy management system includes an articulated arm, a work implement, an energy management system, and a hydraulic circuit. The articulated arm includes hydraulic actuators designed to maneuver the articulated arm, and the work implement is fastened to the articulated arm. The energy management system is adjustable between a first configuration and a second configuration, and includes a hydraulic rotating machine and an electric rotating machine coupled to the hydraulic rotating machine. When the energy management system is in the first configuration, the hydraulic rotating machine and the electric rotating machine function as an electric motor powering a hydraulic pump. When the energy management system is in the second configuration, the hydraulic rotating machine and the electric rotating machine function as a hydraulic motor powering an electric generator. The hydraulic circuit is designed to supply a hydraulic fluid to drive the hydraulic actuators when the energy management system is in the first configuration, and is further designed to recover the hydraulic fluid from the hydraulic actuators and to generate electrical power when the energy management system is in the second configuration.

19 Claims, 6 Drawing Sheets

U.S. PATENT DOCUMENTS 6,635,973 B1 * 10/2003 Kagoshima et al. ..... 307/10.1
6,650,091 B1 11/2003 Shiue et al. ..... 320/166
6,678,972 B2 1/2004 Naruse et al. ..... 37/466
6,683,389 B2 1/2004 Geis ..... 290/40 C
6,708,787 B2 3/2004 Naruse et al. ..... 180/53.8
6,725,581 B2 4/2004 Naruse et al. ..... 37/348
6,789,335 B1 9/2004 Kinugawa et al. ..... 37/348
6,820,356 B2 11/2004 Naruse et al. ..... 37/348
6,850,828 B2 2/2005 Chen ..... 701/50
6,864,663 B2 * 3/2005 Komiyama et al. ..... 320/104
6,870,139 B2 3/2005 Petrenko ..... 219/482
6,876,098 B1 4/2005 Gray, Jr. ..... 290/40 D
6,922,989 B2 * 8/2005 Nagura et al. ..... 60/414
6,922,990 B2 8/2005 Naruse et al. ..... 60/414
6,962,050 B2 11/2005 Hiraki et al. ..... 60/414
7,078,825 B2 7/2006 Ebrahim et al. ..... 290/52
7,078,877 B2 7/2006 Salasoo et al. ..... 320/104
7,096,985 B2 8/2006 Charaudeau et al. .... 180/65.245
7,190,133 B2 3/2007 King et al. ..... 318/375
7,249,457 B2 * 7/2007 Raszga et al. ..... 60/419
7,252,165 B1 8/2007 Gruenwald et al. ..... 180/65.25
7,258,183 B2 8/2007 Leonardi et al. ..... 180/65.1
7,298,102 B2 11/2007 Sopko et al. ..... 318/139
7,378,808 B2 5/2008 Kuras et al. ..... 318/139
7,398,012 B2 7/2008 Koellner ..... 338/830
7,401,464 B2 7/2008 Yoshino ..... 60/414
7,430,967 B2 10/2008 Kumar ..... 105/35
7,439,631 B2 10/2008 Endou ..... 307/9.1
7,444,809 B2 11/2008 Smith et al. ..... 60/414
7,444,944 B2 11/2008 Kumar et al. ..... 105/26.05
7,448,328 B2 11/2008 Kumar ..... 105/35
7,456,509 B2 11/2008 Gray, Jr. ..... 290/40 C
7,479,757 B2 1/2009 Ahmad ..... 318/811
7,518,254 B2 4/2009 Donnelly et al. ..... 290/40 C
7,531,916 B2 5/2009 Franklin et al. ..... 307/64
7,532,960 B2 5/2009 Kumar ..... 701/19
7,533,527 B2 5/2009 Naruse ..... 60/433
7,560,904 B2 7/2009 Alvarez-Troncoso ..... 320/166
7,562,472 B2 * 7/2009 Tozawa et al. ..... 37/348
7,565,801 B2 * 7/2009 Tozawa et al. ..... 60/414
7,571,683 B2 8/2009 Kumar ..... 105/35
7,596,893 B2 * 10/2009 Tozawa et al. ..... 37/348
7,628,236 B1 12/2009 Brown ..... 180/65.21
7,770,696 B2 8/2010 Futahashi et al. ..... 187/224
7,770,697 B2 8/2010 Futahashi et al. ..... 187/224
7,823,379 B2 * 11/2010 Hamkins et al. ..... 60/414
7,905,088 B2 * 3/2011 Stephenson et al. ..... 60/414
8,190,336 B2 * 5/2012 Verkuilen et al. ..... 701/50
8,191,290 B2 * 6/2012 Hughes et al. ..... 37/348
8,207,708 B2 * 6/2012 Morinaga et al. ..... 322/14
8,241,010 B2 * 8/2012 Esch et al. ..... 417/237
2002/0125052 A1 9/2002 Naruse et al. ..... 180/53.8
2004/0098983 A1 5/2004 Naruse et al. ..... 60/428
2004/0117094 A1 * 6/2004 Colburn ..... 701/50
2004/0117095 A1 * 6/2004 Colburn et al. ..... 701/50
2005/0036894 A1 2/2005 Oguri ..... 417/212
2005/0044753 A1 * 3/2005 Lohnes et al. ..... 37/348
2005/0283295 A1 * 12/2005 Normann ..... 701/50
2006/0123672 A1 * 6/2006 Ichimura et al. ..... 37/348
2007/0166168 A1 7/2007 Vigholm et al. ..... 417/20
2007/0278048 A1 * 12/2007 Futahashi et al. ..... 187/272
2008/0110165 A1 * 5/2008 Hamkins et al. ..... 60/414
2008/0110166 A1 * 5/2008 Stephenson et al. ..... 60/414
2008/0128214 A1 * 6/2008 Tahashi et al. ..... 187/224
2008/0290842 A1 11/2008 Davis et al. ..... 320/166
2008/0295504 A1 12/2008 Vigholm et al. ..... 60/327
2008/0314038 A1 * 12/2008 Tozawa et al. ..... 60/414
2009/0036264 A1 * 2/2009 Tozawa et al. ..... 477/5
2009/0077837 A1 * 3/2009 Tozawa et al. ..... 37/361
2009/0178399 A1 * 7/2009 Bishop ..... 60/413
2009/0199553 A1 * 8/2009 Nishimura et al. ..... 60/486
2009/0265047 A1 * 10/2009 Mintah et al. ..... 701/1
2009/0288408 A1 * 11/2009 Tozawa et al. ..... 60/435
2010/0071973 A1 * 3/2010 Morinaga et al. ..... 180/65.265
2010/0076612 A1 * 3/2010 Robertson ..... 700/286
2011/0313608 A1 * 12/2011 Izumi et al. ..... 701/22
2012/0038327 A1 * 2/2012 Yokoyama ..... 320/166
2012/0144819 A1 * 6/2012 Kawashima et al. ..... 60/459
2012/0161723 A1 * 6/2012 Wai et al. ..... 322/22
2012/0180470 A1 * 7/2012 Schroeder et al. ..... 60/414
2012/0224942 A1 * 9/2012 Cherney et al. ..... 414/685

* cited by examiner

ENERGY MANAGEMENT SYSTEM FOR HEAVY EQUIPMENT

BACKGROUND

The present disclosure relates generally to the field of heavy equipment, such as construction and excavation equipment. More specifically, the present disclosure relates to an energy management system for use with hydraulic systems, such as those hydraulic systems generally used with pieces of heavy equipment.

Backhoes, power shovels, and other heavy equipment are used for construction, excavation, and mining. The pieces of heavy equipment operate work implements, such as shovels, buckets, or augers, to perform various tasks. Such equipment may utilize hydraulic systems for maneuvering the work implements in repetitious patterns of working movements. For example, a mining shovel may operate 24 hours per day, raising and lowering a bucket in a repeating cyclic pattern, once approximately every 30 to 60 seconds. Other pieces of heavy equipment, such as drilling rigs, also operate with repeating cycles of raising and lowering a drill or boom but at a slower rate. Energy is required to controllably raise and lower the work implements (e.g., lifting work, braking friction, etc.).

SUMMARY

One embodiment relates to equipment having an energy management system. The equipment includes an articulated arm, a work implement, and an energy management system. The articulated arm includes hydraulic actuators designed to maneuver the articulated arm, and the work implement is fastened to the articulated arm. The energy management system is adjustable between a first configuration and a second configuration, and includes a hydraulic rotating machine and an electric rotating machine coupled to the hydraulic rotating machine. When the energy management system is in the first configuration, the hydraulic rotating machine and the electric rotating machine function as an electric motor powering a hydraulic pump. When the energy management system is in the second configuration, the hydraulic rotating machine and the electric rotating machine function as a hydraulic motor powering an electric generator.

Another embodiment relates to equipment having an energy management system. The equipment includes an articulated arm, a bucket, a sensor system, a controller, a bi-directional valve, and an electric rotating machine coupled to a hydraulic rotating machine. The articulated arm is driven by one or more hydraulic actuators, and the bucket is fastened to the arm and maneuverable by operation of the hydraulic actuators. The first sensor system is coupled to the articulated arm. The controller is coupled to the first sensor system, where data from the first sensor system is used to produce an estimate of potential energy stored in the articulated arm and the bucket. The controller is designed to change a direction of a hydraulic fluid through the bi-directional valve when the estimate of potential energy exceeds a threshold value, and the bucket is being lowered. The electric rotating machine and the hydraulic rotating machine are designed to add energy to the hydraulic fluid, and to remove energy from the hydraulic fluid and generate electricity, depending upon the direction of the hydraulic fluid provided by the bi-directional valve.

Yet another embodiment relates to equipment having an energy management system. The equipment includes an articulated arm, a sensor, a controller, and a bi-directional valve system. The articulated arm is driven by one or more hydraulic actuators, and the articulated arm designed to maneuver at least one of a bucket, a breaker, a grapple, or an auger. The sensor system is designed to detect a position of the articulated arm, and the controller is coupled to the sensor system. The controller is designed to reverse a direction of hydraulic fluid through the bi-directional valve system when the sensor system detects the articulated arm to be in a first position.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
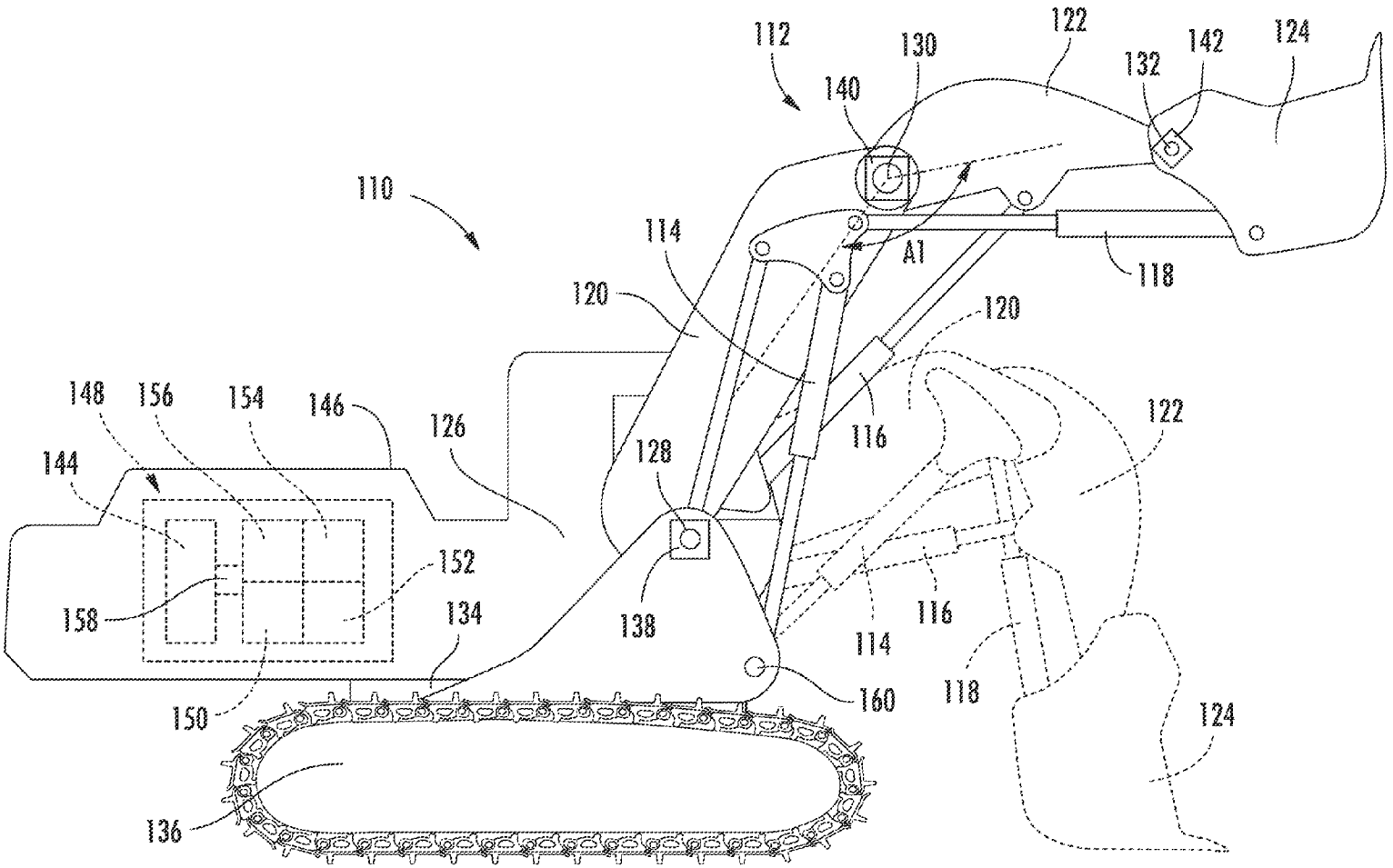
FIG. 1 is a side view of equipment according to an exemplary embodiment.

Referring to FIG. 1, power equipment may use hydraulic systems to drive a work implement. According to at least one exemplary embodiment, hydraulic actuators 114, 116, 118 may be used to drive segments 120, 122 of an articulated arm 112 of a power shovel 110. By way of non-limiting example, the power shovel 110 may have two arm segments 120, 122 (e.g., arms, portions, linkages, etc.) and a bucket 124 (e.g., shovel). In such equipment, a first segment 120 is coupled to a body 126 (e.g., frame, housing, etc.) of the power shovel 110 at a first joint 128 (e.g., pin, pivot, etc.). A second, intermediate segment 122 is coupled to the first segment 120 at a second joint 130. And, the bucket 124 is coupled to the second segment 122 at a third joint 132.

A first hydraulic actuator 114 spans the first joint 160, between the body 126 and the first segment 120. A second hydraulic actuator 116 spans the second joint 130, between the first segment 120 and the second segment 122. And, a third hydraulic actuator 118 spans the third joint 132, between either the first segment 120 or the second segment 122 and the bucket 124. In some embodiments, the hydraulic actuators 114, 116, 118 include a rod (e.g., piston) and barrel (e.g., cylinder) arrangement, in which pressurized hydraulic fluid pushes or pulls the rod relative to the barrel to change the axial length of the hydraulic actuators 114, 116, 118.

In some embodiments, the first, second, and third joints 128, 130, 132 are constrained to allow for rotation of the segments 120, 122 only in a vertical plane. In such embodiments, the body 126 of the power shovel 110 may further be configured to rotate horizontally about a joint 134 positioned below the body 126, such as between the body 126 and a drivetrain 136 (e.g., driveshaft coupled to transmission, coupled to wheels, treads, pontoons, etc.). Horizontal rotation of the body 126 also rotates the articulated arm 112 and the bucket 124.

Each of the hydraulic actuators 114, 116, 118 is configured to controllably expand and contract in length. Actuation of the first hydraulic actuator 114 moves the first segment 120 about the first joint 128. Movement of the first segment 120, in turn, moves the second segment 122 and the bucket 124 about the first joint 128. As such, increasing the length of the first hydraulic actuator 114 rotates the first segment 120 vertically upward, about the first joint 128, raising the second segment 122 and the bucket 124. In a similar manner, the second and third hydraulic actuators 116, 118 may be actuated to controllably maneuver the second segment 122 and the bucket 124.

As the segments 120, 122 of the articulated arm 112 and the bucket 124 are raised, potential energy is acquired. According to a simplified example, such potential energy may be roughly proportional to the product of the height of the center of mass of the articulated arm 112 and the bucket 124 (and any material held therein), the mass thereof, and the acceleration of gravity. A more accurate calculation would also factor frictional energy losses, heat, acoustic losses, electric resistance, and other such losses. As the articulated arm 112 and bucket 124 are lowered, potential energy may be lost, or converted to kinetic energy associated with the movement of the segments 120, 122 and the bucket 124. In some instances, excess kinetic energy is controlled via braking to slow or stop the movement of the segments 120, 122 and the bucket 124. According to an exemplary embodiment, a portion or all of the excess kinetic energy may be converted into electricity via an energy management system having a regeneration process.

According to an exemplary embodiment, the power shovel 110 includes sensors 138, 140, 142 configured to detect and/or quantify movement of the articulated arm 112 and bucket 124. In some embodiments, the sensors 138, 140, 142 are configured to directly measure a position of the articulated arm 112 and the bucket 124. In some such embodiments, the sensors 138, 140, 142 are coupled to the joints 128, 130, 132 of the articulated arm 112 and measure the angle between segments 120, 122 coupled to the joints 128, 130, 132, such as an angle A1 between the first segment 120 and the second segment 122. In some embodiments, the sensors 138, 140, 142 include angular position measuring devices such as encoders, resolvers, potentiometers, etc. The position of the articulated arm 112 and bucket 124 may then be computed with a control circuitry 144 (e.g. processor), which may then be used to provide an estimate of potential energy stored in the articulated arm 112 and the bucket 124. In other embodiments, linear voltage differential transducers (LVDTs) or other sensors are used to measure the length of the actuators. In still other embodiments, different types of commercially-available sensors, coupled either directly or indirectly to the articulated arm, are used.

Figure 3:
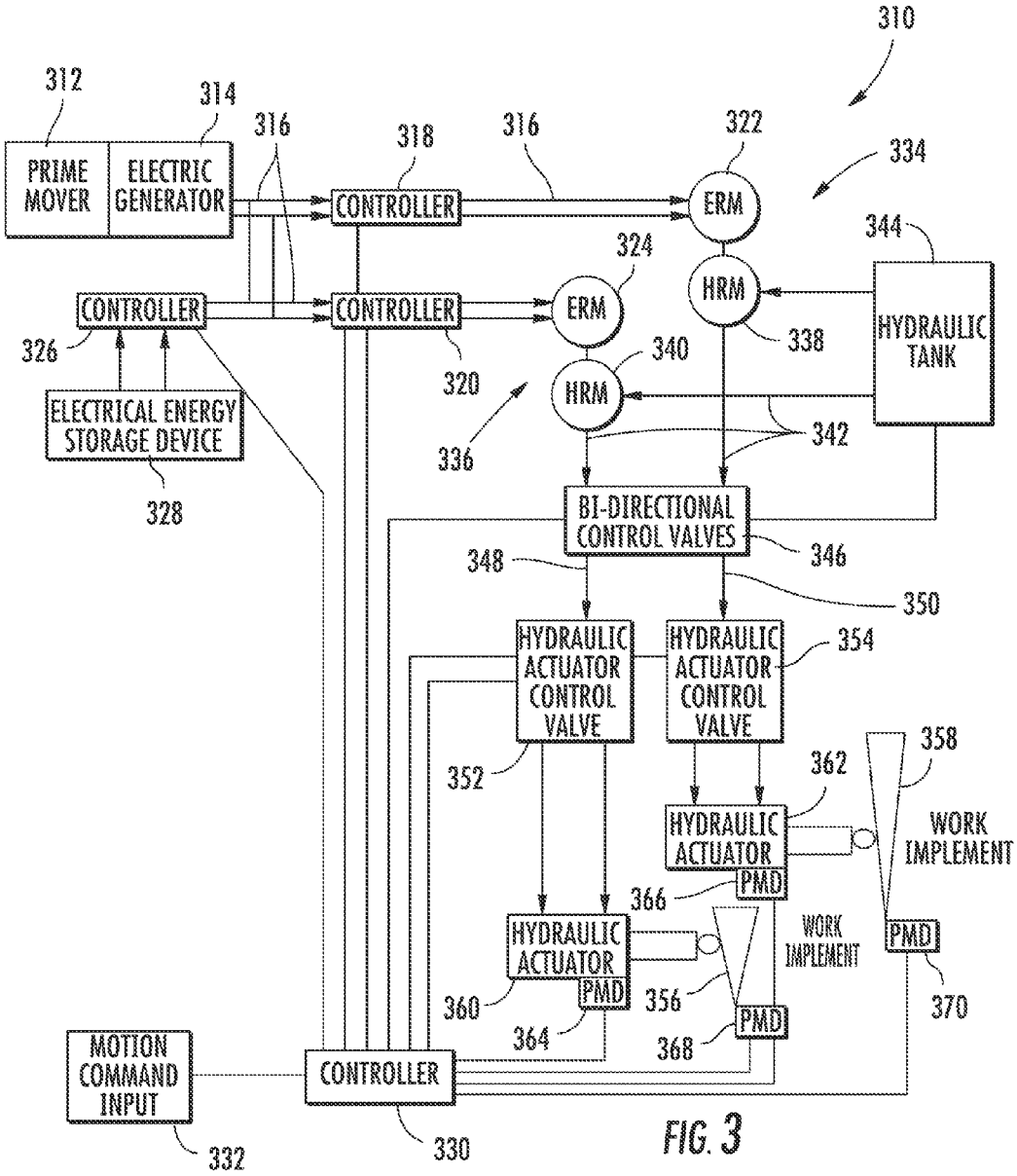
FIG. 3 is a schematic diagram of an energy management system operating in a first configuration according to another exemplary embodiment.

In other embodiments, the sensors 138, 140, 142 measure parameters generally related to the position of the articulated arm 112 and the bucket 124, or other relevant parameters. Based upon measurement of the parameters, the position and/or mass of the articulated arm 112 and the bucket 124 may be estimated, which may then also be used to estimate potential energy. In some such embodiments, strain gauges coupled to the segments 120, 122 of the articulated arm 112 provide information about the weight and orientation of the segments 120, 122 relative to the ground. For example, a first orientation may correlate to increased axial stress, while a second orientation may increase shear stress sensed by strain gauges. In other embodiments, more elaborate systems of sensors may be used (e.g., laser range finders, solid state gyroscopes coupled to the segments, etc.). While the disclosure herein includes a broad range of sensors, such elaborate systems of sensors may be less preferred due to increased cost and complexity. In some embodiments, additional sensors (e.g., pressure sensors, load cells, etc.), sensing pressure of hydraulic fluid in a hydraulic sub-circuit (e.g. sub-circuits 348, 350 as shown in FIG. 3) coupled to a work implement, provide an estimate of the weight of the work implement (e.g., a shovel holding a load). In other embodiments, torque feedback on electric or hydraulic rotating machines is used to measure a load of the system.

Still referring to FIG. 1, the power shovel 110 additionally includes a housing and a frame 146 configured to support components of an energy management system 148. According to an exemplary embodiment, the energy management system 148 includes a prime mover 150 (e.g., internal combustion engine, diesel engine, etc.), an electric generator 152 (e.g., alternator, reversible electric motor, etc.), an electric motor 154 driving a hydraulic pump 156, and a hydraulic control system 158. The prime mover 150 drives the electric generator 152, which produces electricity to drive the electric motor 154. The electric motor 154, in turn, drives the hydraulic pump 156, which drives hydraulic fluid to be controllably supplied to the hydraulic actuators 114, 116, 118 of the articulated arm 112 and the bucket 124 by the hydraulic control system 158. In some embodiments, the hydraulic fluid may also be used drive the horizontal-rotation joint between the body 126 and the drivetrain 136, or other components. In some embodiments, multiple prime movers, electric generators, electric motors, hydraulic pumps, and control systems may be used in combination or separately.

Figure 2:
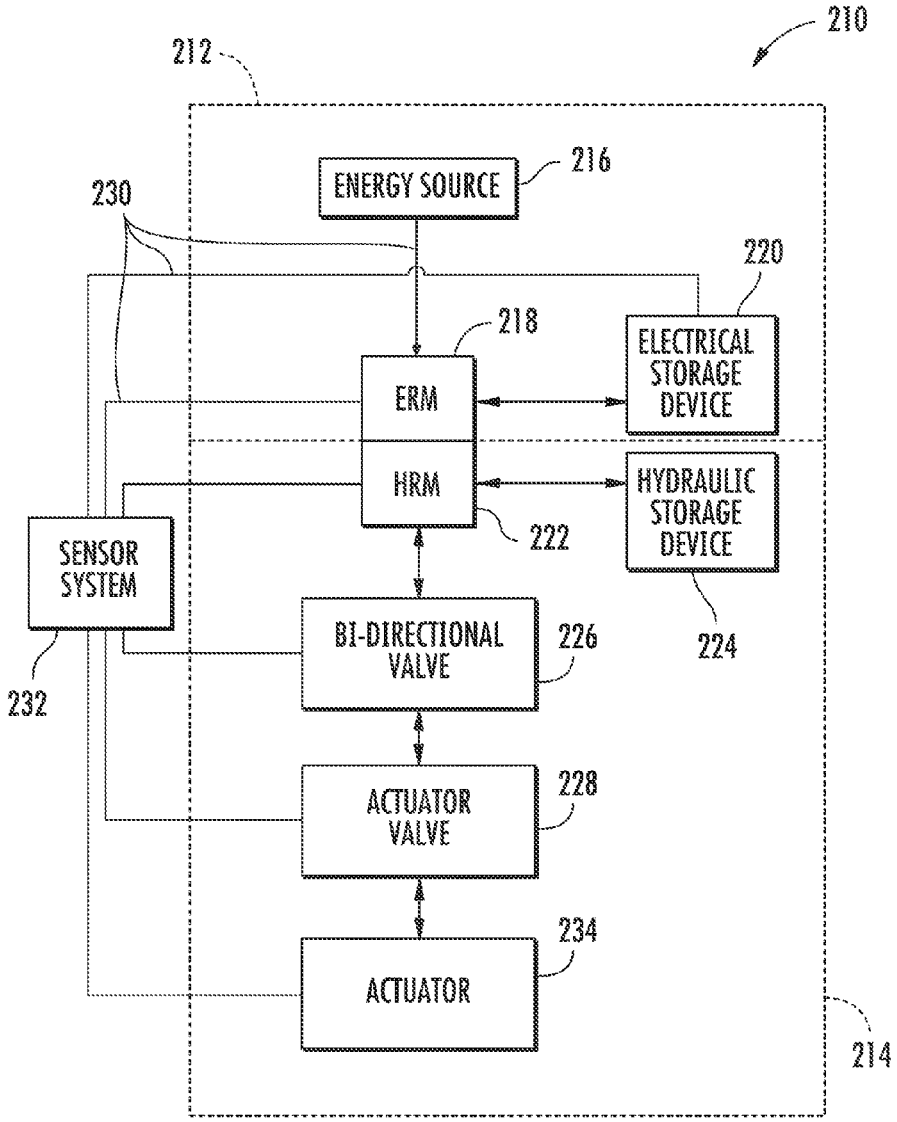
FIG. 2 is a schematic diagram of an energy management system according to an exemplary embodiment.

Referring to FIG. 2, an energy management system 210 for heavy equipment includes an electrical energy system 212 and a hydraulic energy system 214, with the systems 212, 214 operably coupled. The electrical energy system 212 includes an energy source 216, an electrical rotating machine 218 (ERM), and an electrical storage device 220. The hydraulic energy system 214 includes a hydraulic rotating machine 222 (HRM), a hydraulic storage device 224, a bi-directional valve 226, an actuator valve 228, and an actuator 234. In some embodiments, a sensor system 232 includes control circuitry and one or more sensors, and is coupled to various components of the energy management system 210.

The electrical energy system 212 includes the energy source 216, which may include a prime mover and an alternator, as described with regard to FIG. 1. In other embodiments, the energy source 216 includes batteries, capacitors, fuel cells, connection to a power grid, steam, or combinations of energy sources. In some embodiments, the electrical storage device 220 includes batteries (e.g., an array of Lithium-ion batteries), capacitors (e.g., double-layer capacitors, super-capacitors, ultra-capacitors, etc.), flywheels, torsional springs, etc. The electrical rotating machine 218 includes an electric motor (e.g., with rotor and stator), an alternator, and/or an electrical machine capable of both converting electricity to mechanical motion and converting mechanical motion to electricity (e.g., reversible electric motor/generator, or bi-directional electric rotating machine).

The flow of electricity between the components of the electrical energy system 212 may be managed via a control circuitry, sensors, and an electric bus. In some embodiments, the electric bus is an AC bus, a DC bus, or a combination thereof (e.g., including rectifiers). When extra energy is required for the energy management system 210, the sensor system 232 may direct the system to draw power from the energy source 216, and additionally draw power from the electrical storage device 220 and supply the power to the electrical rotating machine 218. When excess power is provided on the bus 230, the excess power may be routed to the electrical storage device 220 or grounded.

The hydraulic energy system 214 includes the hydraulic rotating machine 222, which may include a pump for hydraulic fluid. In some embodiments, the pump is a positive displacement pump, such as an axial cam or triplex piston pump. The pump (e.g., hydraulic rotating machine 222 in a first or forward configuration) is driven by the electrical rotating machine 218 in some embodiments. In other embodiments, the pump is driven by another prime mover. The hydraulic rotating machine 222 may also include a hydraulic motor (or function as a hydraulic motor when the hydraulic rotating machine 222 is in a second or reverse configuration), which converts hydraulic energy into mechanical rotation of a shaft. The hydraulic motor may be coupled to an alternator, such as the alternator of the electrical energy system 212. In some embodiments, the hydraulic rotating machine 222 is configured to operate as both a hydraulic pump and as a hydraulic motor (e.g., bi-directional hydraulic rotating machine).

Still referring to the hydraulic energy system 214 of FIG. 2, the hydraulic storage device 224 (e.g., accumulator tank) is configured to store a reservoir of hydraulic fluid. In some embodiments, the hydraulic storage device 224 is designed to store the hydraulic fluid under pressure, such that potential energy of pressurized hydraulic fluid is controllably stored. The hydraulic energy system 214 further includes the bi-directional valve 226 and the actuator valve 228. The bi-directional valve 226 (e.g., control valve, reversible valve) is configured to control a flow of hydraulic fluid to and from the hydraulic rotating machine 222, or to and from a group of multiple hydraulic rotating machines. The actuator valve 228 is configured to control a flow of hydraulic fluid to and from the actuator 234, such as one of the hydraulic actuators 114, 116, 118 shown in FIG. 1. In some embodiments, the valves 226, 228 are separate and independently controllable by control circuitry of the sensor system 232. In other embodiments, the valves 226, 228 form a single valve or valve system.

As shown in FIG. 2, the electrical energy and hydraulic energy systems 212, 214 of the energy management system 210 are coupled, such as between the electrical rotating machine 218 and the hydraulic rotating machine 222. As such, the energy management system 210 is designed to controllably direct energy from the electrical energy system 212 to the hydraulic energy system 214, as well as to controllably direct energy from the hydraulic energy system 214 to the electrical energy system 212. Energy flowing in the former direction may be transferred from the electric motors to the hydraulic pumps. Energy flowing in the latter direction may be transferred from the hydraulic motors to the electric generators. In some embodiments, energy of the energy management system 210 may be stored in the electrical storage device 220, or in the hydraulic storage device 224 (e.g., as pressurized hydraulic fluid). In certain embodiments, storage of energy in the electrical storage device 220 is preferred.

Figure 4:
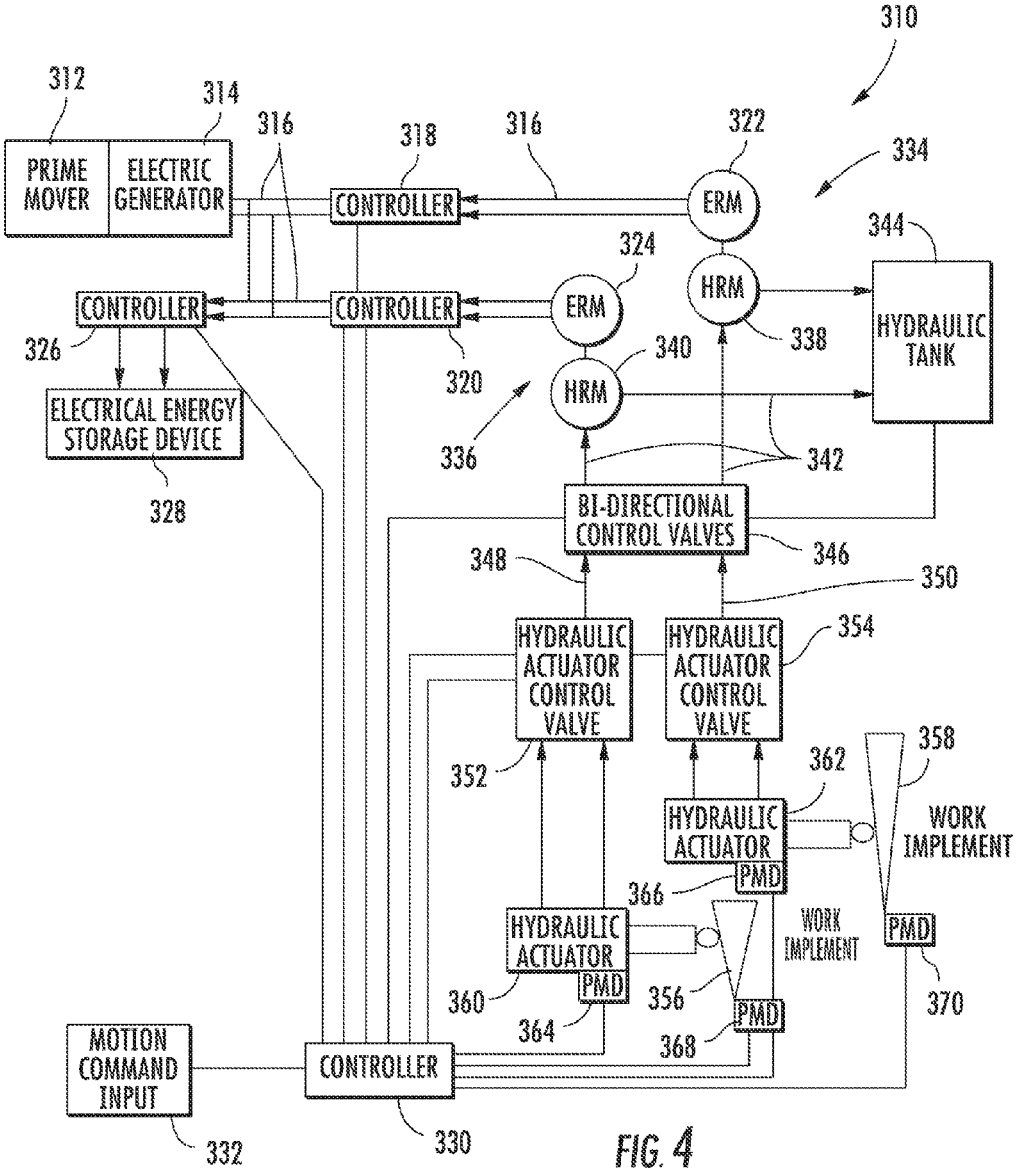
FIG. 4 is a schematic diagram of the energy management system of FIG. 3 operating in a second configuration.

Referring now to FIGS. 3-4, according to another exemplary embodiment, an energy management system 310 is configured to be used with heavy equipment. The system 310 includes a prime mover 312 coupled to an electric generator 314. In some embodiments, the prime mover 312 is an internal combustion engine. Electricity from the electric generator 314 enters a bus 316 coupled to controllers 318, 320 (e.g., motor drive controllers) for two electrical rotating machines 322, 324 (ERMs) and a controller 326 (e.g., state of charge controller) for an electrical energy storage device 328. In other embodiments, other numbers of electrical rotating machines and energy storage devices may be coupled to the bus 316 (see, e.g., electrical rotating machine 218 as shown in FIG. 2). Additionally, each of the controllers 318, 320, 326 may be controlled by a main controller 330 (e.g., processor, computer, circuitry, etc.) also coupled to the bus 316. The main controller 330 may be coupled to a motion command input 332, or other interface, which may receive instructions from a human or automated operator.

The energy management system 310 further includes a first rotating-machine pair 334 and a second rotating-machine pair 336, either pair 334, 336 including an electrical rotating machine 322, 324 and a hydraulic rotating machine 338, 340. As described with regard to other embodiments, the electrical rotating machines 322, 324 are configured to drive the hydraulic rotating machines 338, 340 during a first flow of energy through the system 310, and the hydraulic rotating machines 338, 340 are configured to drive the electrical rotating machines 322, 324 during a second flow of energy through the system 310. With the first flow of energy (see FIG. 3), the electrical rotating machines 322, 324 function as electric motors that drive the hydraulic rotating machines 338, 340, which function as hydraulic pumps. With the second flow of energy (see FIG. 4), the hydraulic rotating machines 338, 340 function as hydraulic motors, and the hydraulic rotating machines 338, 340 drive the electrical rotating machines 322, 324, which function as electric generators. In other embodiments, other numbers of rotating-machine pairs are used (e.g., at least two, at least four, one, etc.). In still other embodiments, a single electrical rotating machine is coupled to more than one hydraulic rotating machine (e.g., via gearing), or a single hydraulic rotating machine is coupled to more than one electrical rotating machine.

Each of the hydraulic rotating machines 338, 340 is coupled to a hydraulic circuit 342 (e.g., hydraulic system, plumbing, bus, etc.), which additionally includes a hydraulic tank 344 and a bi-directional control valve 346. In some embodiments, the bi-directional control valve 346 includes a number of individual valves (e.g., cartridge valves, spool valves, etc.), sharing a common manifold, with each individual valve coupled to a particular hydraulic sub-circuit 348, 350 (e.g., branch, sub-system, etc.). Each sub-circuit 348, 350 is coupled to a hydraulic actuator 360, 362 configured to drive a work implement 356, 358 (or other hydraulically-driven component). The main controller 330 is coupled to the bi-directional control valve 346, and is configured to operate the bi-directional control valve 346 to manage the flow of hydraulic fluid through the system 310. According to an exemplary embodiment, the directional flow of hydraulic fluid provided by the bi-directional control valve 346 provides an ability to raise and lower the work implements 356, 358, while recapturing potential energy (with the same set of components). Additionally, because potential energy of the work implements 356, 358 is converted to electrical energy and stored instead of being converted to heat (e.g., during braking), the temperature of the hydraulic fluid may be reduced, decreasing power required for heat exchangers to cool the hydraulic fluid, and increasing a usable life of hydraulic components, such as seals.

Still referring to FIGS. 3-4, as described, the energy management system 310 further includes the sub-circuits 348, 350, each sub-circuit 348, 350 coupled to one of the work implements 356, 358. According to an exemplary embodiment, the system 310 is a single (i.e., unitary) bi-directional system, where potential energy of the work implements 356, 358 may be recaptured through the same system components that provide motion to raise the work implements 356, 358, reducing the number of components, cost, and complexity of the system 310—as opposed to using separate systems for driving the work implement and recapturing energy. For example, a less-efficient embodiment may use an engine to drive a hydraulic pump, and an electric generator and separate hydraulic motor to recapture energy. Conversely, in some preferred embodiments no duplication of components occurs, and the same components are used during both raising and lowering of the work implement.

In some embodiments, the system 310 may include hydraulic actuators 360, 362 (e.g., hydraulic cylinders, telescopic cylinders, plunger cylinders, differential cylinders, rephrasing cylinders, position-sensing "smart" hydraulic cylinders, or other commercially-available actuators) coupled to the work implements 356, 358 or other components, such as segments of an articulated arm (see, e.g., FIG. 1). Each actuator 360, 362 is coupled to one of the hydraulic actuator control valves 352, 354 is configured to control a flow of hydraulic fluid into or out of the hydraulic actuators 360, 362. In some embodiments, the hydraulic actuator control valves 352, 354 are integrated into the bi-directional control valve 346. In other embodiments, valves in addition to the bi-directional control valve 346 and the hydraulic actuator control valves 352, 354 are used to further control hydraulic fluid passing through the system 310. The hydraulic actuators 360, 362 are coupled to the work implements 356, 358, allowing for control of the work implements 356, 358 by the motion command input 332, as relayed through the energy management system 310.

According to an exemplary embodiment, position measuring devices 364, 366 (PMD) or other sensors are coupled to each hydraulic actuator 360, 362, which provide data to the main controller 330 relating to the position of the work implements 356, 358 or the state of the hydraulic actuators 360, 362. Additional position measuring devices 368, 370, such as LVDTs or load cells, are optionally coupled to the work implements 356, 358 or related components, which may provide additional data useful to the main controller 330 and/or operator.

According to an exemplary embodiment, the main controller 330 uses the data provided by the position measuring devices 364, 366, 368, 370 to estimate a quantity of potential energy stored in the work implements 356, 358. If an instruction is provided to adjust the work implements 356, 358 in a manner that would release the potential energy (e.g. lower a shovel work implement, etc.), then a processor of the main controller 330 (e.g., control circuitry, control logic) is configured to compute whether to reverse the bi-directional control valve 346 to allow the hydraulic fluid to drive the hydraulic rotating machines 338, 340, to in turn drive the electrical rotating machines 322, 324, to generate electricity. For example, if the main controller 330 estimates that the electricity gained will exceed the energy cost associated with reversing the bi-directional control valve 346, then the main controller 330 may reverse the bi-directional control valve 346. Electrical energy generated from the potential energy of the work implements 356, 358 may then be directed over the bus 316 to the electrical energy storage device 328, and later used.

Figure 5:
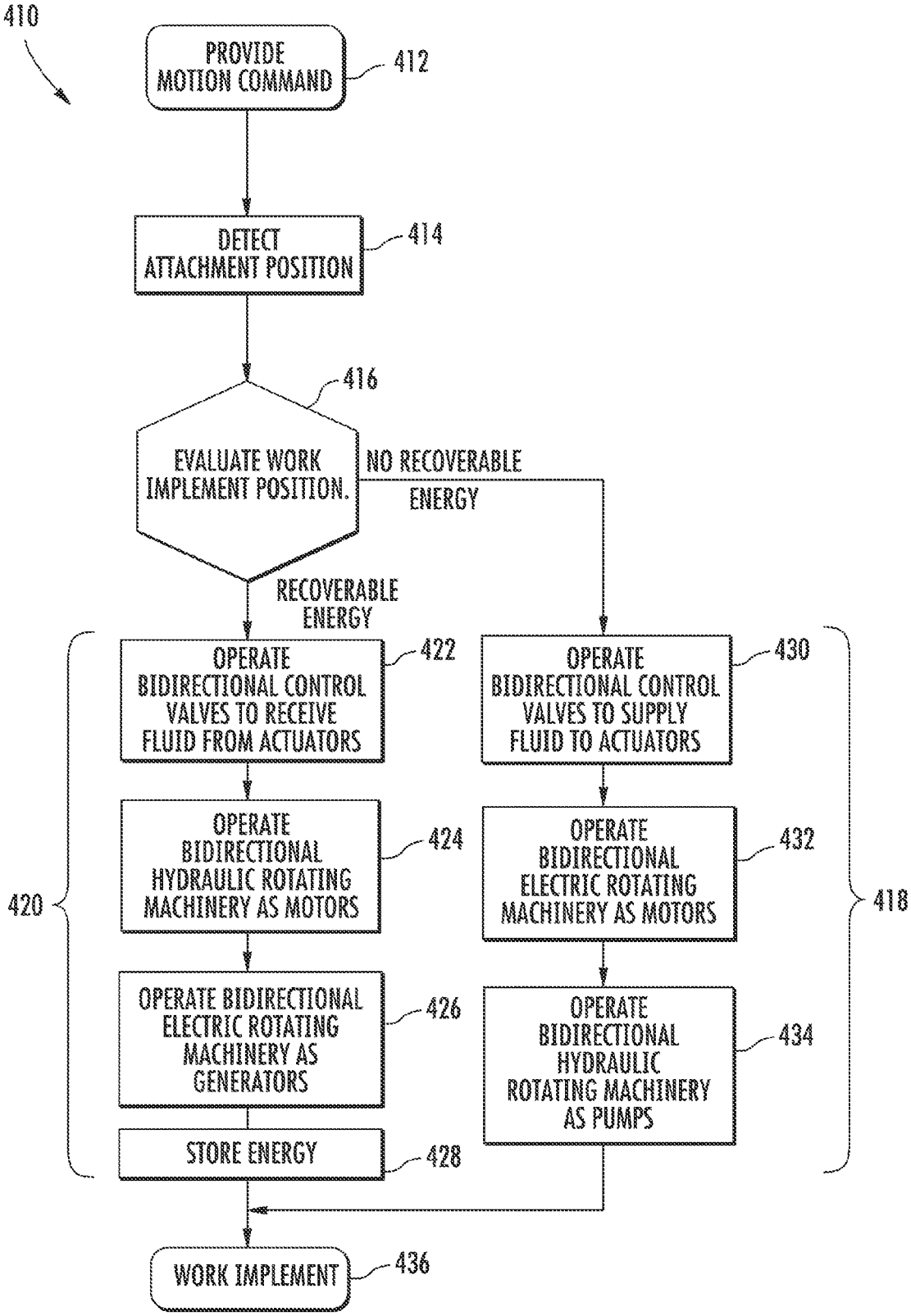
FIG. 5 is a flowchart for control of an energy management system according to an exemplary embodiment.

Referring to FIG. 5, a method for operating an energy management system 410 includes several steps. One step 412 includes providing a motion command, such as a command to maneuver a work implement or other attachment. The motion command step 412 may first be provided to a main control circuitry via human-to-machine or machine-to-machine interface (e.g., remote, joy stick, console, etc.). The motion command step 412 may include instructions for maneuvering the attachment (e.g., arm segments 120, 122 as shown in FIG. 1) in a manner that would increase, decrease, or not change potential energy stored in the attachment. Another step 414 includes detecting a position of the attachment. More specifically, the step 414 includes detecting a vertical and horizontal position of the attachment relative to a pivot axis (see, e.g., joints 128, 130, 132 as shown in FIG. 1). The step 414 further includes estimating the position based upon data provided by sensors (see, e.g., PMDs 364, 366 as shown in FIGS. 3-4).

Yet another step 416 includes estimating a potential energy gain (or absence of such) based upon the position estimation. In other embodiments, the step further or alternatively includes estimating a potential energy gain based upon a computation of energy to be generated by maneuvering the attachment in a repeating pattern. If the estimate shows that energy may be recoverable, then a first sequence 418 of additional steps may be performed. But if the estimate shows that energy may not be recoverable, a second sequence 420 of additional steps may be performed. In other embodiments, if the estimate shows that the recoverable energy exceeds a predetermined threshold value, the first sequence 418 of additional steps will be performed. The threshold may correspond to energy costs associated with reversing the bi-directional valve, or other costs (e.g., momentum of hydraulic fluid, friction, etc.).

If the estimate of recoverable energy provided by the estimating step is positive, then control circuitry of the system may provide several instructions, resulting in the performance of the first sequence 418 of additional steps. One step 422 includes operating a bi-directional valve of the energy management system to receive hydraulic fluid from the actuators. Another step 424 includes operating hydraulic rotating machines, coupled to the bi-directional valve, as hydraulic motors. As such, the step 424 further includes receiving the hydraulic fluid and converting energy in the hydraulic fluid into rotation of a shaft of a hydraulic rotating machine. Yet another step 426 includes operating the electrical rotation machines as electric generators. As such, the step 426 further includes receiving rotational mechanical energy from the hydraulic rotating machines, and converting the rotational mechanical energy into electricity. Yet another step 428 may include storing or using the electricity.

If the estimate of recoverable energy provided by the estimating step is negative, then control circuitry of the system may provide several instructions, resulting in the performance of the second sequence 420 of additional steps. One step 430 includes operating the bi-directional valve of the energy management system to provide hydraulic fluid to the actuators. Another step 432 includes operating the electric rotating machines as electric motors, where electricity is converted into rotational mechanical energy in the form of a rotating shaft of the motors. Yet another step 434 includes operating the hydraulic rotating machines a hydraulic pumps, adding energy to a flow of hydraulic fluid (e.g., pressurizing the fluid). Yet another step 436 includes using the hydraulic fluid to drive a work implement.

Figure 6:
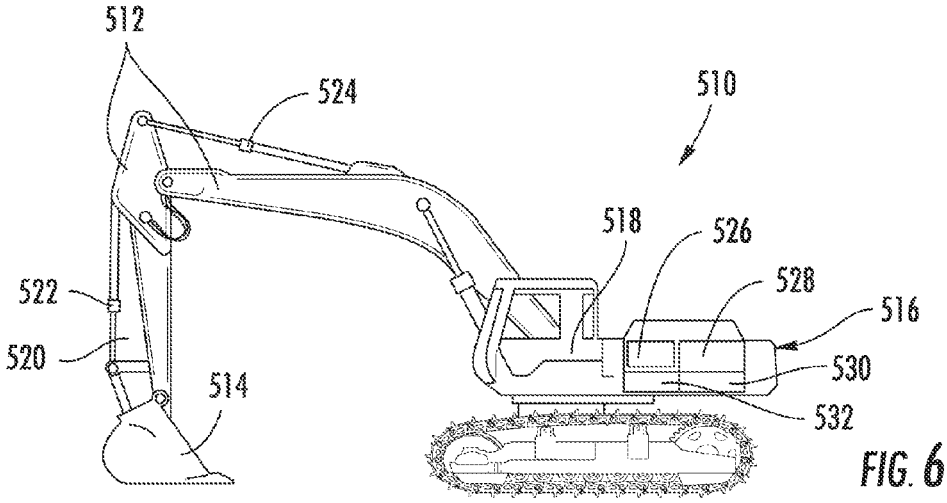
FIG. 6 is a side view of equipment according to an exemplary embodiment.
Figure 7:
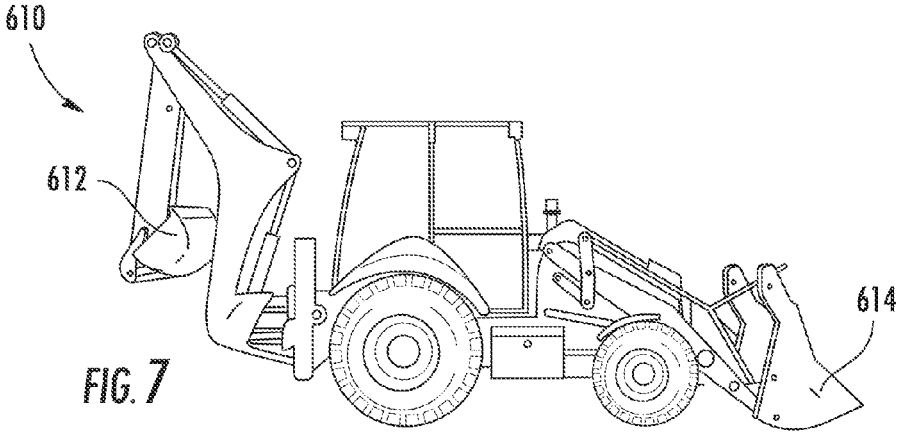
FIG. 7 is a side view of equipment according to another exemplary embodiment.
Figure 8:
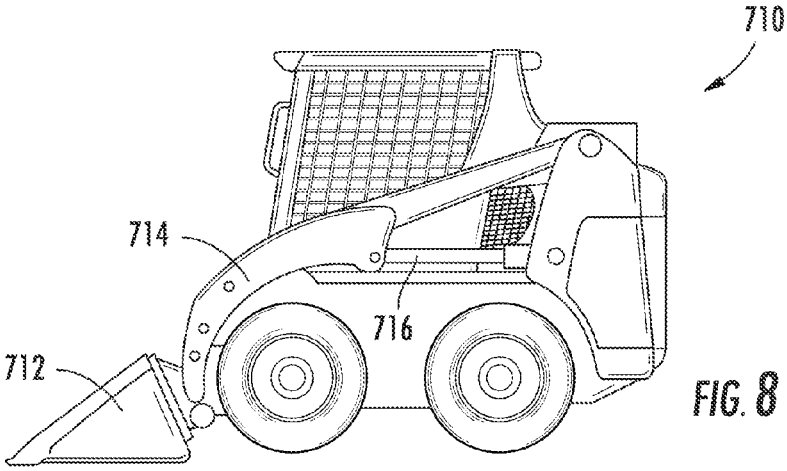
FIG. 8 is a side view of equipment according to yet another exemplary embodiment.

Referring to FIGS. 6-8, energy management systems disclosed herein relates generally to a broad range of hydraulically-driven equipment. Preferably the equipment includes hydraulic actuators (e.g., linear hydraulic cylinders) to maneuver a work implement or other component that is configured to perform cyclic tasks (e.g., lifting and lowering). Referring to FIG. 6, an energy management system 516 may be used to regenerate electrical power with movement of an articulated arm 512 and a bucket 514 of an excavator 510. The articulated arm 512 pulls the bucket 514 toward a body 518 of the excavator 510, cyclically lifting a segment 520 of the arm 512 and the bucket 514. Sensors 522, 524 may be positioned in or otherwise coupled to the articulated arm 512, to provide data for an estimate of potential energy stored in the arm 512. If a processor 526 associated with the excavator 510 estimates that the potential energy exceeds a threshold, then the processor 526 may reverse a bi-directional valve 528 internal to the excavator 510, to allow the hydraulic fluid to drive a hydraulic rotating machine 530 and an electric rotating machine 532, to generate energy. Referring to FIGS. 7-8, an energy management system as described herein may be used to regenerate electrical power with movement of either a backhoe 612 or a loader bucket 614 for construction equipment 610. Also, an energy management system as described herein may be used with a shovel 712 of a skid loader 710 maneuvered by parallel articulated arms 714 and actuators 716. According to still various other exemplary embodiments, an energy management system as described herein may be used with a crane having an arm raised by actuators, with a basket or a hook on an end of the crane. An energy management system as described herein may be used having a drilling rig with a boom supporting a drill. Further, an energy management system as described herein may be used in a hydraulic lifting platform or elevator.

The construction and arrangements of the energy management systems and equipment, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, in some embodiments, rotational momentum of the equipment may be regenerated into electrical energy. In another example, pneumatic actuators and pumps may be substituted for hydraulic actuators and pumps as described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. Equipment having an energy management system, comprising:

an articulated arm having hydraulic actuators configured to maneuver the articulated arm;

a work implement coupled to the articulated arm;

control circuitry configured to estimate a quantity of potential energy stored in the articulated arm and the work implement;

angular position measuring devices coupled to joints of the articulated arm; and an energy management system adjustable between a first configuration and a second configuration, wherein the energy management system comprises:

a hydraulic rotating machine, and an electric rotating machine coupled to the hydraulic rotating machine, wherein in the first configuration the hydraulic rotating machine and the electric rotating machine function as an electric motor powering a hydraulic pump, and wherein in the second configuration the hydraulic rotating machine and the electric rotating machine function as a hydraulic motor powering an electric generator.

2. The equipment of claim 1, further comprising a hydraulic circuit configured to supply a hydraulic fluid to drive the hydraulic actuators when the energy management system is in the first configuration, and wherein the hydraulic circuit is further configured to recover the hydraulic fluid from the hydraulic actuators and to generate electrical power when the energy management system is in the second configuration.

3. The equipment of claim 2, wherein the hydraulic circuit comprises a cartridge valve system configured to direct the hydraulic fluid from the hydraulic rotating machine to the hydraulic actuators when the energy management system is in the first configuration, and to direct the hydraulic fluid from the hydraulic actuators to the hydraulic rotating machine when the energy management system is in the second configuration.

4. The equipment of claim 3, wherein the control circuitry is configured to change the direction of the hydraulic fluid through the cartridge valve system when the estimate exceeds a threshold value and the work implement is being lowered.

5. The equipment of claim 4, further comprising position measuring devices coupled to the hydraulic actuators, wherein the control circuitry is configured to use data from the position measuring devices to estimate the quantity of potential energy.

6. The equipment of claim 5, wherein the position measuring devices comprise linear position measuring devices.

7. The equipment of claim 4, wherein the control circuitry is configured to use data from the angular position measuring devices to estimate the quantity of potential energy.

8. The equipment of claim 7, wherein the angular position measuring devices comprise at least one of encoders or resolvers.

9. Equipment having an energy management system, comprising:

an articulated arm driven by one or more hydraulic actuators;

a sensor system coupled to the articulated arm, the sensor system comprising an angular position measuring device configured to sense a configuration of a joint of the articulated arm;

a controller coupled to the sensor system, wherein data from the sensor system is used to produce an estimate of potential energy stored in the equipment;

a bi-directional valve, wherein the controller is configured to change a direction of a hydraulic fluid through the valve when the estimate exceeds a threshold value and the articulated arm is being lowered; and an electric rotating machine coupled to a hydraulic rotating machine, wherein the electric rotating machine and the hydraulic rotating machine are configured to add energy to the hydraulic fluid, and to remove energy from the hydraulic fluid and generate electricity, depending upon the direction of the hydraulic fluid provided by the bi-directional valve.

10. The equipment of claim 9, wherein the sensor system further comprises a linear position measuring device configured to sense a configuration of a hydraulic actuator used to maneuver the articulated arm.

11. The equipment of claim 9, wherein the angular position measuring device comprises at least one of an encoder or a resolver.

12. The equipment of claim 9, wherein the bi-directional valve is a cartridge valve system.

13. Equipment having an energy management system, comprising:

an articulated arm driven by one or more hydraulic actuators;

a sensor system configured to detect a position of the articulated arm;

a controller coupled to the sensor system;

a bi-directional valve system, wherein the controller is configured to reverse a direction of a hydraulic fluid flowing through the valve system when the sensor system detects the articulated arm to be in a first position;

a hydraulic rotating machine, wherein rotation of the hydraulic rotating machine in a first direction adds energy to the hydraulic fluid, and rotation of the hydraulic rotating machine in a second direction removes energy from the hydraulic fluid, and wherein the bi-directional valve system is configured to control the hydraulic fluid flowing to and from the hydraulic rotating machine;

an electrical rotating machine coupled to the hydraulic rotating machine and configured to power the hydraulic rotating machine; and a torque feedback system coupled to the electrical rotating machine.

14. The equipment of claim 13, wherein rotation of the hydraulic rotating machine by the electrical rotating machine expends electricity, and rotation of the electrical rotating machine by the hydraulic rotating machine generates electricity.

15. The equipment of claim 14, further comprising an electrical generator and a combustion engine, the combustion engine configured to power the electrical generator and the electrical generator configured to supply electricity to the electrical rotating machine.

16. The equipment of claim 15, further comprising an electrical energy storage device, wherein the electrical energy storage device is configured to store electrical energy generated by the electrical rotating machine.

17. The equipment of claim 16, wherein the electrical energy storage device comprises at least one of a capacitor and a battery.

18. The equipment of claim 13, wherein data from the torque feedback system and data from the sensor system are used by the controller to provide an estimate of potential energy stored in the articulated arm, and wherein the estimate is used by the controller when determining whether to reverse the bi-directional valve system.

19. Equipment having an energy management system, comprising:

an articulated arm having hydraulic actuators configured to maneuver the articulated arm;

a work implement coupled to the articulated arm;

control circuitry configured to estimate a quantity of potential energy stored in the articulated arm and the work implement;

position measuring devices coupled to the hydraulic actuators, wherein the control circuitry is configured to use data from the position measuring devices to estimate the quantity of potential energy; and an energy management system adjustable between a first configuration and a second configuration, wherein the energy management system comprises:

a hydraulic rotating machine, and an electric rotating machine coupled to the hydraulic rotating machine, wherein in the first configuration the hydraulic rotating machine and the electric rotating machine function as an electric motor powering a hydraulic pump, and wherein in the second configuration the hydraulic rotating machine and the electric rotating machine function as a hydraulic motor powering an electric generator.

* * * * *